United States Patent [19]

Fox

[11] 4,162,022

[45] Jul. 24, 1979

[54] CLOSURER AND METHOD FOR SEALING A FLOATING TANK ROOF

[76] Inventor: William M. Fox, 5735 Alhambra Ave., Martinez, Calif. 94553

[21] Appl. No.: 912,259

[22] Filed: Jun. 5, 1978

[51] Int. Cl.[2] ..... B65D 87/18; B65D 87/20

[52] U.S. Cl. ..... 220/224

[58] Field of Search ..... 220/221-224

[56] References Cited

U.S. PATENT DOCUMENTS

| | | | |
|---|---|---|---|
| 1,666,416 | 4/1928 | Griffin | 220/224 |
| 1,900,904 | 3/1933 | Berger | 220/224 |
| 2,772,805 | 12/1956 | Grundig | 220/224 |
| 3,019,935 | 2/1962 | Anderson | 220/224 |
| 3,565,279 | 2/1971 | Joor | 220/224 |

*Primary Examiner*—George T. Hall
*Attorney, Agent, or Firm*—Phillips, Moore, Weissenberger, Lempio & Majestic

[57] ABSTRACT

A tank roof seal is provided for use in the sealing of tanks, such as for example, those used in the oil refinery industry. The tank roof seal comprises a mounting bracket and a shoe resiliently secured thereto. The mounting bracket is attachable about a periphery of a tank roof, which roof floats on the liquid contained in the tank. A flexible fabric seal interconnects the top of the shoe with the top of the bracket. The tank seal includes a turnbuckle for selectively restricting the extension of the resiliently secured shoe from the bracket. Thus, as the tank seal is mounted to the floating roof, as for example occurs for in situ retrofitting, the shoe can be restrained from contacting the tank wall until the retrofitting has been completed. Further, for in situ retrofitting, the bracket of the tank roof seal is adapted to mount directly to the mounts provided on the floating roof for an original seal. In addition, the tank roof seal can itself be included as original equipment.

8 Claims, 5 Drawing Figures

CLOSURER AND METHOD FOR SEALING A FLOATING TANK ROOF

TECHNICAL FIELD

The present invention relates to tank roof seals for use in the sealing of tanks, such as those used in the oil refining industry, wherein the seal is provided about the periphery of a tank roof, which roof floats on a liquid contained in the tank.

BACKGROUND ART

To prevent the ullage, that is to say the space between the fluid level in a tank and the fixed top of the tank from filling with volatile fumes, it is common practice in the oil refinery industry to provide a floating roof or pontoon on top of the fluid. As the floating roof rises or sinks with the addition or withdrawal of fluid from the tank, there is no ullage which can be filled with volatile gases. However, to prevent the escape of volatile fumes from between the tank and the floating roof, there is a need to provide a tank roof seal about the periphery of the floating roof and in contact with the side of the tank.

Heretofore a number of devices have been used to provide a sealing relationship between the floating roof of the tank and the side walls thereof. Such devices are disclosed in U.S. Pat. No. 1,650,340, issued to Glass on Nov. 22, 1927, and U.S. Pat. No. 1,735,461 issued to Haupt on Nov. 12, 1929. Both systems utilize flexible annular tubes located about the periphery of the floating roof to form a seal between the floating roof and the sides of the tank. However, it has been found that the flexible annular tube, which is generally comprised of an elastomeric material is abraded against the tank wall as the floating tank roof rises or sinks owing to the change in the amount of fluid in the tank. Such abrading reduces the effectiveness of the seal and eventually can allow vapors and sometimes liquid to escape from the tank through the seal. As stricter environment protection standards are imposed, such seals become increasingly unsatisfactory. Thus, there is a need to provide a tank seal which will meet the newest environment protection standards.

Additionally, as there are a number of tanks which are fitted with the aforementioned flexible annular seals, which must be retrofitted with tank seals which meet the newest environment protection standards, there is a need to provide a tank seal which can be used to quickly and easily retrofit roofs. It is to be understood that such retrofitting can most easily and conveniently be accomplished in situ. That is to say the seal should be retrofitable without the necessity of draining the fluid or oil from the tank. Additionally, it is noted that to retrofit in situ, neither welding nor any other process which creates a flame or sparks can be used as such procedures would create the possibility of an explosion, should highly volatile and explosive fuels be contained in the tank.

Examples of other floating seals wherein a metallic shoe is substituted for the flexible annular tube and a resilient mechanism or a weight biased mechanism is used to extend the shoe from the floating roof into contact with the side of the tank can be found in for example the following patents: U.S. Pat. No. 1,900,904 issued to Berger on Mar. 14, 1933; U.S. Pat. No. 2,587,508 issued to Moyer on Feb. 26, 1952; U.S. Pat. No. 2,772,805 issued to Grundig on Dec. 4, 1956; and U.S. Pat. No. 3,019,935 issued to Anderson on Feb. 6, 1962. These systems essentially show seals which can be included as original equipment with a floating roof. However, none of these seals are adaptable for retrofitting an existing liquid filled tank.

DISCLOSURE OF THE INVENTION

The present invention is directed to overcoming one or more of the problems as set forth above.

In an aspect of the present invention, a tank roof seal is disposable about the periphery of a tank roof floating on a fluid contained in the tank. The tank roof seal comprises a bracket, means for securing the bracket to the tank roof, and a shoe positionable against the tank. Further, the tank roof seal comprises means for resiliently mounting the shoe to the bracket. Flexible sealing means are provided between the shoe and the bracket. The tank seal further includes means for selectively restricting the extension of the resilient mounting means for positioning the shoe relative to the bracket and out of contact with the tank. The restricting means assist in the in situ retrofitting of the tank seal to a floating tank roof.

Another aspect of the present invention includes apertures provided on the bracket which are adapted to mate with mounts provided on the roof for in situ retrofitting the bracket to the tank roof.

Another aspect of the present invention includes a method for retrofitting a new tank seal about the periphery of a tank roof floating on the fluid contained in a tank. Utilizing the above-indicated tank seal, the method comprises the steps of restricting the extension of the resilient mounting means so that the shoe is provided in a fixed relationship with respect to the bracket, mounting the bracket about the periphery of the tank, releasing the shoe from the fixed relationship with the bracket so that the shoe contacts the tank, and removing the restricting means.

As the shoe of the present invention can be metallic, the tank roof seal will not abrade as the floating roof is raised and lowered, and thus as the shoe slides along the tank wall, in correspondence to the change of the volume of fluid contained in the tank.

As indicated above, with the restricting means, and the apertures provided in the bracket for receiving mounts from the floating roof, the tank roof seal can be retrofitted to the floating roof in situ. Thus, the tank need not be drained prior to retrofitting as the bracket can be secured to the tank roof without the need for welding operations and the like, which welding operations would be inadvisable in such a volatile environment.

Other advantages will become apparent from the following description of the best mode of the invention.

BEST MODE FOR CARRYING OUT THE INVENTION

Figure 1:
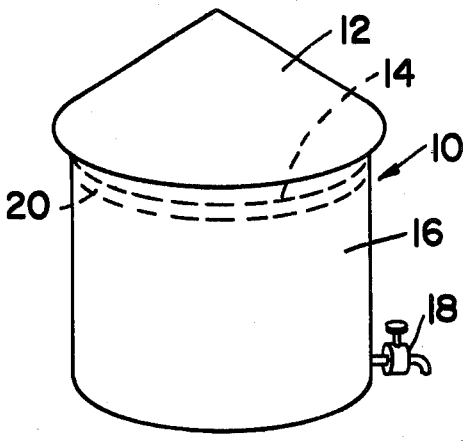
FIG. 1 depicts a tank having a floating roof fitted with an embodiment of the tank roof seal of the present invention.

With reference to FIG. 1 of the drawings, a tank 10 is depicted with a fixed roof 12. A floating roof 14 is depicted floating on the fluid 16 contained in tank 10. In a contemplated environment, such as that found in the oil refinery industry, the fluid would comprise, for example, a hydrocarbon which would most likely have a quite volatile nature. A valve 18 is depicted at the bottom of the tank for purposes of draining the tank. A roof tank seal 20 is mounted about the periphery of floating roof 14.

With reference to FIG. 2, tank seal 20 is again depicted affixed to floating roof 14. Tank seal 20 includes a plurality of mounting brackets which are generally denoted 22 (also see FIG. 5), and a plurality of shoes generally denoted 24. The shoes are resiliently mounted to the mounting brackets by a plurality of resilient mechanisms generally denoted 26, which devices are more fully described hereinbelow. A flexible sealing membrane 28 is attached to the top of the shoe and also to the top of the mounting bracket.

Figure 2:
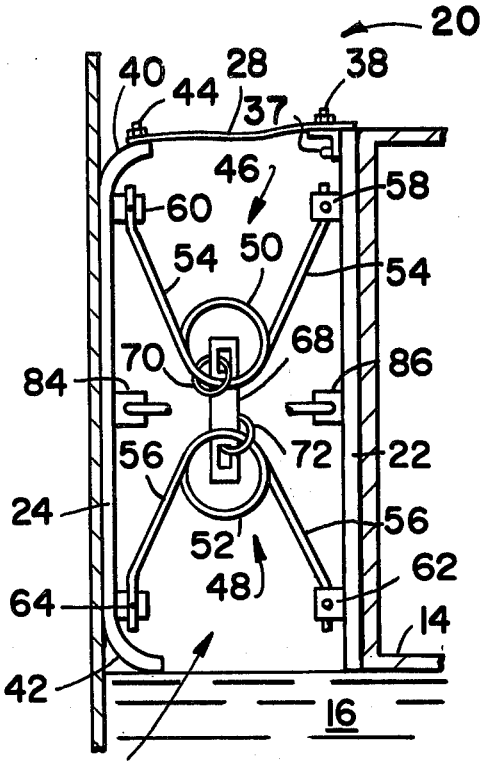
FIG. 2 depicts a side cross-sectional view of the tank seal of the present invention as shown in FIG. 1 with a portion of a restricting mechanism thereof removed.
Figure 4:
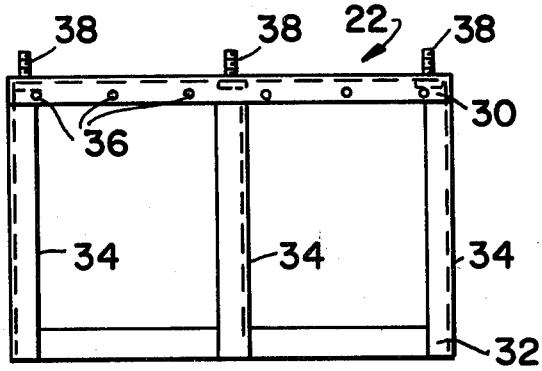
FIG. 4 depicts the mounting bracket of the present invention of FIG. 1.

Examining mounting bracket 22 more fully, and viewing FIGS. 2 and 4, it can be seen that mounting bracket 22 includes a rectangular structure with upper and lower cross beams 30 and 32 and vertical connecting beams 34. Beams 30 and 32 can be slightly arcuate to conform to the periphery of the floating roof as will be described later with relationship to FIG. 5. As can be seen in FIG. 4, beam 30 includes a plurality of bores 36 which are adapted to mate with mounts provided on the floating roof 14 for securing the bracket to said floating roof. In addition, upstanding bolts 38 are provided extended from beam 30, which upstanding bolts are received by corresponding apertures provided in the flexible sealing member 28 for securing sealing member 28 to bracket 22.

Shoe 24 includes arcuate upper and lower portion 40 and 42 respectively. The arcuate portions assist in the sliding of the shoe against the wall of the tank as the floating roof changes position due to the change of the volume of fluid in the tank. Upstanding from the arcuate upper portion 38 are a plurality of bolts 44. Bolts 44 are adapted to be received by corresponding apertures provided in the flexible seal member 28 for securing sealing member 28 to shoe 24.

In the preferred embodiment, flexible sealing member 28 can be comprised of an elastomeric material formed about, if desired, appropriate skeletal structure comprised of, for example, wires, cords or strands. It is to be understood that the flexible sealing member 28 must be impervious to corrosive environments in which it must operate.

Resilient mechanisms 26 are comprised of two springs 46 and 48. Springs 46 and 48 include single coiled bodies 50 and 52, which bodies are adjacently positioned. Extending from each coiled body is a pair of spring rods 54 and 56 respectively. As viewed in FIG. 2, spring rods 54 project upwardly and spring rods 56 project downwardly. The ends of spring rods 54 are pivotally pinned in spring brackets 58 and 60 which spring brackets are secured to mounting bracket 22 and shoe 24 respectively. Also, the ends of spring rods 56 are secured to spring brackets 62 and 64 which are secured to mounting bracket 22 and shoe 24. Spring 46 and 48 are loosely retained with respect to each other by retention member 68 which has one ring 70 provided at one end thereof and disposed about spring coil body 50 and another ring 72 provided at the other end thereof disposed about spring coil body 52. Rings 70 and 72 are slidingly mounted in apertures provided at the respective ends of retention member 68. Thus, within the limits defined by retention member 68, spring 46 can act independently of spring 48 to allow the greatest conformity of shoe 24 to the side of the tank 10 as the position of floating roof 14 changes owing to the change in the volume of fluid in the tank.

Figure 3:
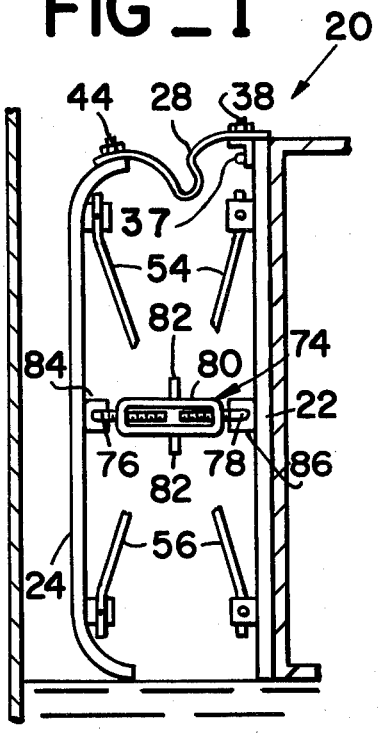
FIG. 3 depicts the view of FIG. 2 with a portion thereof cut away to expose the restricting mechanism.

Viewing FIG. 3, spring 46 and 48 are cut away to reveal a restricting device or turnbuckle 74 which can be adjusted to selectively position shoe 24 with respect to mounting bracket 22. Turnbuckle 74 includes two L-shaped screws 76 and 78 (FIG. 5) which are threadingly received in link 80. Fingers 82 project perpendicularly from link 80 to facilitate the rotation thereof with respect to the screws. The bent end of each L-shaped screw is slidingly received in brackets 84 and 86 of shoe 24 and mounting bracket 26 respectively. It is noted that FIG. 3 depicts the turnbuckle as restricting the extension of the springs 46 and 48 such that the shoe 24 is held in a position, spaced from the wall of tank 10.

Figure 5:
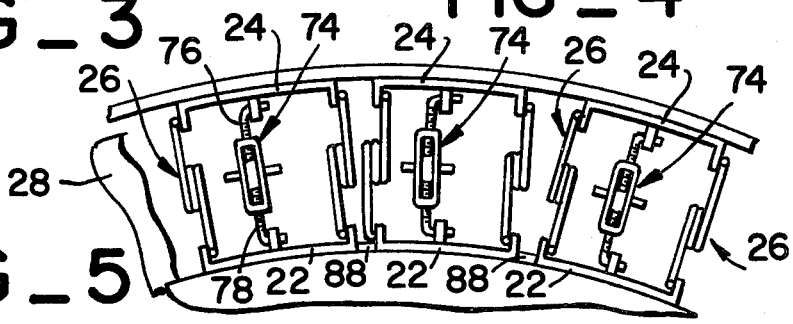
FIG. 5 depicts a cut away plan view of a portion of the tank roof seal of the invention as depicted in FIG. 1.

Viewing FIG. 5, flexible seal member 28 is shown partially cut away, revealing a plan view of the mounting brackets and shoes of the tank roof seal. The plurality of arcuately shaped mounting brackets 22 are depicted interconnected by appropriate hinges 88. As can be seen, two of the plurality of resilient mechanisms 26 are used to mount each shoe 24 to each mounting bracket 22. Located intermediate the resilient mechanism is the turnbuckle 74.

INDUSTRIAL APPLICABILITY

The operation of the tank roof seal 20 is as follows: Tank roof seal 20 can be used as original equipment on the floating roof of a tank, and in the alternative can be used to retrofit a tank roof in situ. As original equipment, the mounting bracket 22 can be bolted or, in fact, welded to the floating tank roof as there is no danger of explosion due to the fact that the tank would not have been filled.

For in situ retrofitting, the original, or to be replaced tank seal is removed from the floating roof leaving only the original seal mounts used to secure the original seal to the tank roof. Prior to positioning tank seal 20 around the periphery of the floating roof 14, flexible sealing member 28 is removed to allow access to the turnbuckle 74 and also the mounting bracket 22. Then link 80 of turnbuckle 74 is rotated in order to draw shoe 24 toward mounting bracket 22 so as to restrict the extension of the resilient mechanism 26. With the tank seal 20 so restricted, said seal is quite easily positioned between the wall of the tank and the floating roof.

With the tank seal 20 positioned between the tank wall and the periphery of the floating roof, the apertures of the mounting bracket can be received by the original mounts provided on the floating roof. Appropriate fasteners, such as bolts 37 and the like, can be used to secure the mounting bracket to the roof, eliminating the need for welding. Once the mounting brackets 22 are secured about the periphery of the tank roof, fingers 82 are used to rotate the link 80 of the turnbuckle 74 until the shoe 24 contacts the sides of tank 10. With all the shoes so positioned, the turnbuckle 74 are removed from the seal 20. With the turnbuckles removed, the resilient mechanisms 26 are free to position the floating roof with respect to the tank. Should an imbalance occur in the centering of the tank roof with respect to the tank wall, the resilient mechanism 26 will re-center the tank roof.

The turnbuckle 74 having beem removed, the flexible sealing member 28 is secured to the shoes and the mounting brackets by the bolts upstanding from the shoes and the mounting brackets, which are received in appropriate apertures in the flexible sealing member. The flexible sealing member 28 as previously indicated, prevents the loss of volatile gases from the tank as it forms a seal between the mounting bracket and the shoes. Thus, the tank seal roof 20 is affixed to the floating roof, in situ, without the need for welding, and without the need for draining the tank of the volatile fluid.

Other aspects, objects and advantages of this invention can be obtained from a study of the drawings, the disclosure and the appended claims. Further is is noted that various modifications to the embodiment of the invention would be known and appreciated by one of ordinary skill in the art.

What is claimed is:

1. A tank roof seal disposable about the periphery of a tank roof floating on a fluid contained in a tank comprising:

a bracket;

means for securing the bracket to the tank roof;

a shoe positionable against the tank;

means for resiliently mounting the shoe to the bracket;

means for providing a seal between the shoe and the bracket, said seal means being flexible;

means for selectively restricting the extension of the resilient mounting means for positioning the shoe relative to the bracket and out of contact with the tank.

2. The apparatus of claim 1 wherein said restricting means includes a turnbuckle.

3. The apparatus of claim 1 wherein said restricting means is removably secured to the shoe and to the bracket.

4. The apparatus of claim 1 wherein said resilient mounting means includes a pair of springs and means for interconnecting said springs, which interconnecting means allows one spring to act relatively independently of the other while maintaining a spatial relationship between said springs.

5. The apparatus of claim 1 wherein the tank roof has mounts and wherein the means for securing the bracket to the tank roof includes apertures which are adapted to mate with the roof mounts for retrofitting the bracket to the tank roof.

6. A method for retrofitting a tank roof seal about the periphery of a tank roof floating on a fluid contained in a tank wherein the new tank seal includes a bracket, a shoe, means for resilient mounting the shoe to the bracket and means for selectively restricting the extension of the resilient mounting means, which restricting means is removably mounted to the shoe and the bracket, the method including the steps of:

restricting the extension of the resilient mounting means so that the shoe is provided in a fixed relationship with respect to the bracket;

mounting the bracket about the periphery of the tank roof;

releasing the shoe from the fixed relationship with the bracket so that the shoe contacts the tank; removing the restricting means.

7. The method of claim 6 wherein the tank roof is originally provided with a tank roof seal including the steps of:

removing the original tank roof seal with the exception of original tank roof seal mounts secured to the roof preparatory to retrofitting the roof with the tank roof seal; and wherein the step of mounting the bracket to the tank roof includes the step of mounting the bracket to the original tank roof seal mounts.

8. The method of claim 6 further including the step of:

spreading a flexible, fluid tight material between the shoe and the bracket.

* * * * *